United States Patent [19]

Thimot

[11] 4,416,129

[45] Nov. 22, 1983

[54] CYLINDER LOCK WITH KEY REMOVABLE PLUG

[75] Inventor: Robert P. Thimot, Marlboro, Mass.

[73] Assignee: Hudson Lock, Inc., Hudson, Mass.

[21] Appl. No.: 270,501

[22] Filed: Jun. 4, 1981

[51] Int. Cl.[3] ..... E05B 15/14; E05B 29/02

[52] U.S. Cl. ..... 70/369; 70/377

[58] Field of Search ..... 70/367, 368, 369, 376, 70/377, 392

[56] References Cited

U.S. PATENT DOCUMENTS

| | | | |
|---|---|---|---|
| 1,805,891 | 5/1931 | Shinn | 70/369 |
| 1,990,934 | 2/1935 | Falk | 70/369 |
| 2,061,456 | 11/1936 | Falk | 70/369 |
| 2,460,709 | 2/1949 | Navarro | 70/369 |
| 4,272,975 | 6/1981 | Patriquin | 70/369 |

*Primary Examiner*—Robert L. Wolfe

*Attorney, Agent, or Firm*—John E. Toupal; Harold G. Jarcho

[57] ABSTRACT

A cylinder lock with a shell defining a plug cavity, a plurality of locking shell tumblerways, and a control shell tumblerway. A plug is rotatable within the plug cavity and defines a plurality of locking plug tumblerways alignable with the locking shell tumblerways, a control plug tumblerway alignable with the control shell tumblerway and a keyway for receiving keys. Positioned within each of the locking plug tumblerways is a locking tumbler that is biased into an active position wherein it projects into one of the locking shell tumblerways and movable into an inactive position out of the tumblerway by a proper key in the keyway. The locking tumblers prevent rotation of the plug when in their active positions and allow rotation thereof when in their inactive positions. Retained by the control plug tumblerway is a control tumbler biased in a latched position and movable into a release position by a control key in the keyway. Also defined by the shell is an arcuate groove that receives ends of the control tumbler so as to accommodate rotational movement of the plug while preventing axial movement thereof. After use of a proper key to rotate the plug from a locked position to an open position, an end of the control tumbler can be forced into the control shell tumblerway by a control key in the keyway. Entry of the control tumbler into the control shell tumblerway eliminates axial interference between the control tumbler and the groove.

11 Claims, 6 Drawing Figures

CYLINDER LOCK WITH KEY REMOVABLE PLUG

BACKGROUND OF THE INVENTION

This invention relates generally to locks and, more particularly, to a cylinder lock with a locking core that can be removed with a proper key.

A substantial cost of maintaining many security systems involves the required removal of locks from the structures on which they have been installed. For example, security reasons necessitate lock removal for rekeying of a lock in certain instances. The requirement for rekeying can result from either a loss of keys to the lock or the termination of an employee having had access to a key for the lock. Lock removal also can be required to effect repair of a faulty lock.

The lock removal problem is somewhat alleviated in a type of lock commercially known as a Best cylinder lock. The Best lock employs a latching mechanism that can be actuated by a proper key to permit removal of a locking core from the lock's housing. Although substantially reducing the time required for lock removal and thereby the cost of either rekeying or repair, the Best locks exhibit the disadvantages of relatively high cost and a size that is excessive for many applications.

Other key removable locks are disclosed in U.S. Pat. Nos. 1,986,676 and 4,191,037 and in U.S. Application Ser. No. 06/055,925 filed July 6, 1979, and assigned to the assignee of this application. Although useful in many applications, these locks also suffer from various individual and common disadvantages such as the requirement for additional parts or for special manufacturing and assembling techniques. In addition, prior key removable locks have required a master key for lock removal and have therefore been subject to removal by anyone in possession of a master key. This is undesirable in that there are instances in which the functions associated with a master key and those of lock removal should not be available to the same personnel.

The object of this invention, therefore, is to provide an improved, relatively low cost cylinder lock having operational flexibility, reasonable security and a locking core that can be easily removed with a control key.

SUMMARY OF THE INVENTION

The invention is a cylinder lock with a shell defining a plug cavity, a plurality of locking shell tumblerways, and a control shell tumblerway. A plug is rotatable within the plug cavity and defines a plurality of locking plug tumblerways alignable with the locking shell tumblerways, a control plug tumblerway alignable with the control shell tumblerway and a keyway for receiving keys. Positioned within each of the locking plug tumblerways is a locking tumbler that is biased into an active position wherein it projects into one of the locking shell tumblerways and movable into an inactive position out of the tumblerway by a proper key in the keyway. The locking tumblers prevent rotation of the plug when in their active positions and allow rotation thereof when in their inactive positions. Retained by the control plug tumblerway is a control tumbler biased in a latched position and movable into a release position by a control key in the keyway. Also defined by the shell is an arcuate groove that receives ends of the control tumbler so as to accommodate rotational movement of the plug while preventing axial movement thereof. After use of a proper key to rotate the plug from a locked position to an open position, an end of the control tumbler can be forced into the control shell tumblerway by a control key in the keyway. Entry of the control tumbler into the control shell tumblerway eliminates axial interference between the control tumbler and the groove. Thus, when in the open position, the plug can be removed from the shell by one having possession of a control key but not necessarily possessing either a proper or a master key.

In a preferred embodiment of the invention, the plug rotates 180 degrees between the locked and open positions. In this embodiment, the control tumbler has one end with given dimensions that prevent its entry into the control shell tumblerway and an opposite end of different dimensions that permit its entry thereinto. The one end is biased out of the plug into the groove and the opposite end is aligned with the control shell tumblerway with the plug in the open position so as to be movable thereinto by a control key. The control shell tumblerway is intersected by and of greater depth than the groove so as to receive the opposite end of the control tumbler only during movement of its one end out of the groove. This embodiment provides for the invention the desirable traits of a cylinder lock utilizing 180-degree opening movement.

According to one feature of the invention, the locking tumblers are positioned between the control tumbler and the entrance to the keyway. This arrangement complicates any attempt to pick the control tumbler by one not in possession of a control key and with the plug in the open position.

DESCRIPTION OF THE DRAWINGS

These and other objects and features of the present invention will become more apparent upon a perusal of the following description taken in conjunction with the accompanying drawings wherein.

DESCRIPTION OF THE PREFERRED EMBODIMENT

Figure 1:
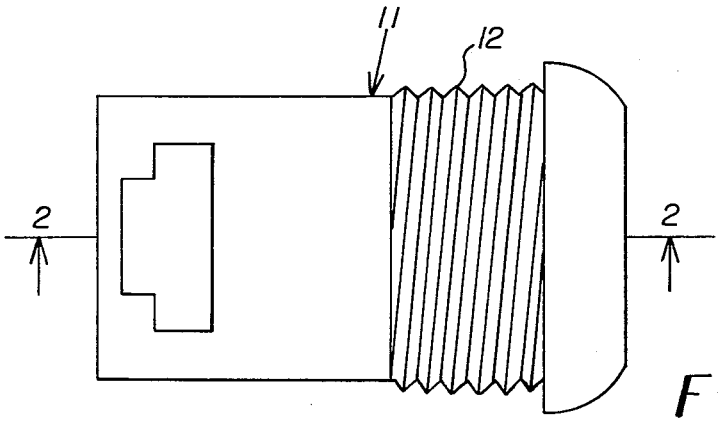
FIG. 1 is a schematic top view of a hollow shell for a cylindrical lock according to the invention.
Figure 2:
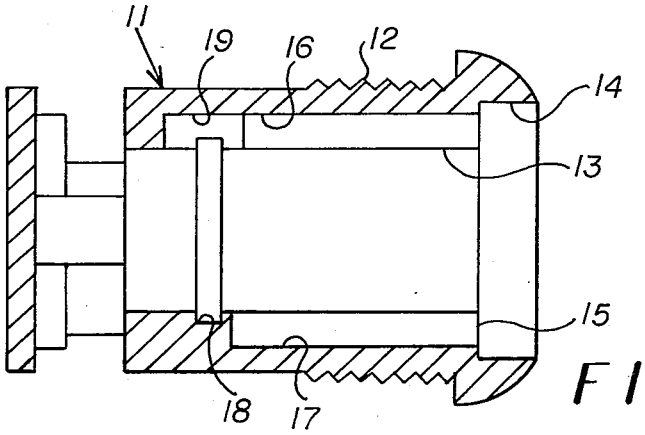
FIG. 2 is a schematic cross-sectional view taken along the lines 2—2 of FIG. 1.
Figure 3:
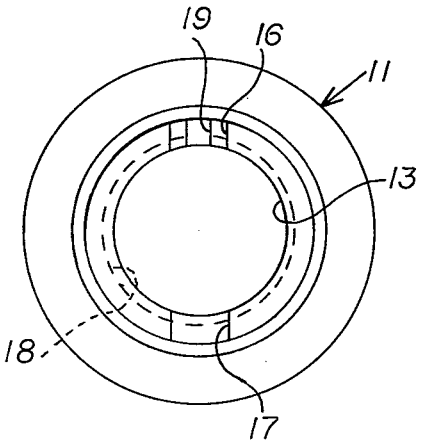
FIG. 3 is a schematic view of the open end of the shell shown in FIGS. 1 and 2.

Shown in FIGS. 1 and 2 is a cylindrical shell 11 having an externally threaded portion 12 to facilitate mounting in a suitable housing (not shown). Defined within the shell 11 is a cylindrical plug cavity 13 for receiving a locking plug as described hereinafter. A counterbore 14 establishes an annular shoulder 15 encircling the open end of the plug cavity 13. Also defined by the shell 11 is a locking spline 16 that forms a plurality of locking shell tumblerways. The locking spline 16 extends axially of the shell cavity 13 and opens into the counterbore 14. Diametrically opposed to the locking spline 16 is an auxiliary spline 17 that also extends axially of the shell cavity 13 and opens into the counterbore 14. Rearwardly of the splines 16 and 17 is a circular groove 18 formed concentrically in the plug cavity 13. Intersected by and of greater depth than the groove 18 is a control spline 19 that forms a control shell tumblerway axially aligned with the locking spline 16. As shown in FIG. 3, the width of the locking spline 16 is greater than that of the control spline 19.

Figure 4:
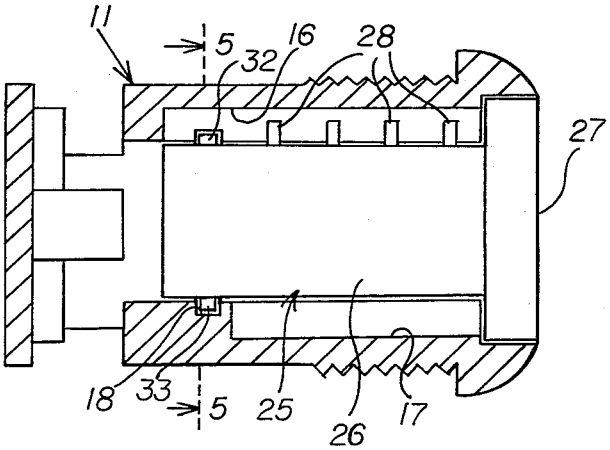
FIG. 4 is a schematic cross-sectional view illustrating a plug positioned within the shell as shown in FIG. 2.

Referring now to FIG. 4, there is shown a cylindrical plug 25 having an inner body portion 26 retained by the plug cavity 13 and a head portion 27 accommodated by the counterbore 14. Retained within conventional locking plug tumblerways in the plug 25 are a plurality of locking tumbler wafers 28. In a conventional manner, the locking wafers 28 are biased into active positions wherein they project into the locking spline 16 to prevent rotational movement of the plug 25. However, in response to insertion of a proper key (not shown) into a keyway within the plug 25, the locking tumblers 28 are drawn into shear positions that remove them from the locking spline 16 so as to permit rotation of the plug 25 from a locked to an open position as described below. During the insertion of a proper key, excessive movement of the locking tumblers 28 is accommodated by the auxiliary spline 17.

Figure 5:
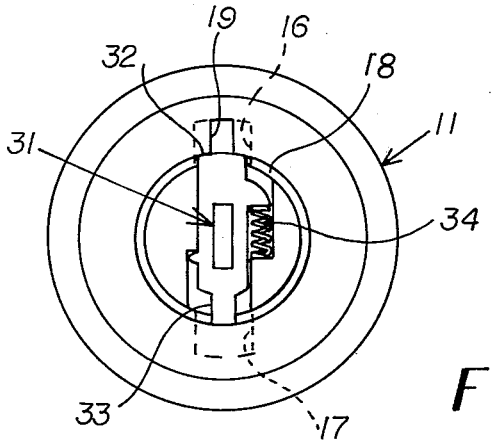
FIG. 5 is a schematic cross-sectional view taken along the lines 5—5 of FIG. 4 and with the plug oriented in a locked position within the shell.

Also retained by the plug 25 in a control plug tumblerway is a control tumbler wafer 31 shown most clearly in FIG. 5. The control wafer 31 has one end 32 that extends out of the plug 25 and into the groove 18 and an opposite end 16 that also extends out of the plug 25 and into the groove 33 in a location diametrically opposite to the one end 32. A spring member 34 biases the one end 32 of the control wafer 31 into the groove 18 and against the inner surface thereof. As shown in FIG. 5, the width of the control spline 19 is less than that of the control wafer end 32 so that the inner surface of the groove 18 forms a stop that prevents entry of the wafer end 32 into the spline 19. Thus, the groove 18 accommodates the control wafer ends 32 and 33 during rotational movement of the plug 25 after movement of the locking tumblers 28 into inactive shear positions by the proper key. However, the groove 18 defines blocking and abutment sidewall surface portions that engage the protruding ends 32 and 33 of the control wafer 31 so as to prevent axial withdrawal of the plug 25 from the shell 11.

Figure 6:
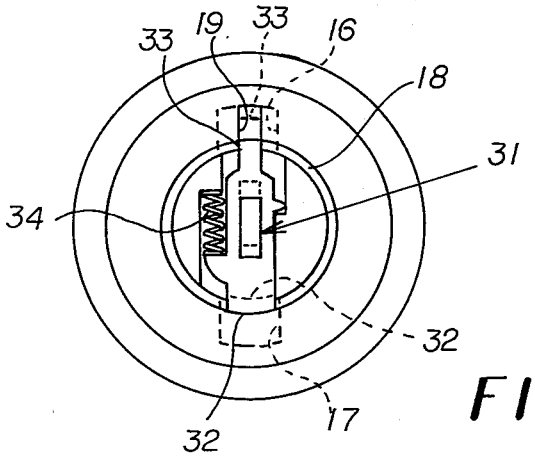
FIG. 6 is a schematic cross-sectional view similar to that of FIG. 5 but with the plug in an open position within the shell.

Removal of the plug 25 from the shell 11 can be accomplished only after 180-degree movement of the plug into the open position illustrated in FIG. 6. In that position, the opposite end 33 of the control wafer 31 is aligned with the control spline 19. As shown in FIG. 6, the width of the opposite control wafer end 33 is less than either that of the control wafer end 32 or the control spline 19. Thus, in response to insertion into the plug 25 of a suitable bitted control key (not shown) the bias provided by the spring member 34 is overcome forcing the control wafer 31 out of its latched position shown by solid lines in FIG. 6 into a release position shown by dotted lines therein. In the release position, the narrow opposite end 33 of the wafer 31 projects into the control spline 19 and the wider one end 32 is withdrawn from the groove 18. The plug 25 can then be withdrawn axially from the shell 11. During the withdrawal movement, the movement of the locking wafers 28 is accommodated by the auxiliary spline 17 while axial movement of the opposite control wafer end 33 is sequentially accommodated by the axially aligned and joined control spline 19 and locking spline 16.

Reassembly of the lock is accomplished by a reverse operation. With a control key within the plug 25 and the control wafer thereby withdrawn to the release position shown by dashed lines in FIG. 6, the plug body 26 is inserted into the open position within the plug cavity 13. While exerting a force on the plug head portion 27 so as to retain the plug 25 within the plug cavity 13, the control key is withdrawn to return the control wafer 31 to the latched position shown by solid lines in FIG. 6. In that position, the control wafer end 32 again extends into the groove 18 so as to prevent axial movement of the plug 25. Conventional rotational movement of the plug 25 between the open position shown in FIG. 6 and the locked position shown in FIG. 5 can then be accomplished in the conventional manner with a proper key.

It will be noted that the plug removal operation described above does not require a control key bitted so as to draw the locking tumblers 28 into their inactive shear positions. Thus, removal of the plug 25 from the shell 11 does not require the use of either a proper or master key capable of inducing rotational movement of the plug 25 between open and locked positions. However, any attempt to pick the control wafer 31 with the plug 25 in its open position is subverted by the relative positions of the locking wafers 28. Any such picking attempt would require projection of a picking tool through the circuitous path presented by the locking wafers 28 within the plug keyway.

Obviously, many modifications and variations of the present invention are possible in light of the above teachings. It is to be understood, therefore, that the invention can be practiced otherwise than as specifically described.

What is claimed is:

1. A cylinder lock comprising:

a shell defining a plug cavity, a plurality of locking shell tumblerways, and a control shell tumblerway;

a plug received by and rotatable in said plug cavity between locked and open positions and defining a plurality of locking plug tumblerways alignable with said locking shell tumblerways, a control plug tumblerway alignable with said control shell tumblerway, and a keyway for receiving keys;

a locking tumbler positioned in each of said locking plug tumblerways, each of said locking tumblers being biased into an active position and movable into an inactive position by a proper key in said keyway, and wherein said locking tumblers prevent rotation of said plug when in said active positions and allow rotation thereof when in said inactive positions;

a control tumbler retained by said control plug tumblerway and biased into a latched position and movable into a release position by a control key in said keyway;

blocking means axially engaging said control tumbler with said plug in said locked position so as to prevent axial withdrawal thereof from said shell;

stop means preventing movement of said control tumbler into a position that eliminates said axial engagement between said blocking means with said plug in said locked position; and abutment means shaped and arranged with said plug in said open position to prevent axial withdrawal thereof with said control tumbler in said latched position and to permit axial withdrawal thereof with said control tumbler in said release position.

2. A cylinder lock according to claim 1 wherein said locking tumblers project into said locking shell tumblerways when in said active positions, and said control tumbler projects into said control shell tumblerway when in said release position.

3. A cylinder lock according to claim 2 wherein with a proper key in said keyway said plug is rotatable from said locked position to said open position, and said control tumbler and control plug tumblerway are shaped and arranged so as to permit entry thereinto of said control tumbler only with said plug in said open position.

4. A cylinder lock according to claim 3 wherein said plug rotates 180 degrees between said locked and open positions, said control tumbler has one end with given dimensions that prevent its entry into said control shell tumblerway and an opposite end with different dimensions that permit its entry thereinto, said one end is biased out of said plug, and said opposite end is aligned with said control shell tumblerway with said plug in said open position.

5. A cylinder lock according to claim 4 wherein said shell further defines an arcuate groove having surfaces that form said blocking means, said stop means, and said abutment means; said groove intersecting said control shell tumblerway and receiving said one end only with said control tumbler removed from said control shell tumblerway, and said groove accommodating said one end during rotational movement of said plug while preventing axial movement thereof.

6. A cylinder lock according to claim 5 wherein said control shell tumblerway is of greater depth than said groove.

7. A cylinder lock according to claim 6 wherein said locking shell tumblerways are formed by an axial locking spline in the surface of said cavity, said control shell tumblerway is formed by a control spline in said surface, and said control spline is axially aligned with and of lesser width than said locking spline.

8. A cylinder lock according to claim 7 wherein said locking tumblers are positioned between said control tumbler and the entrance to said keyway.

9. A cylinder lock according to claim 1 wherein said shell further defines an arcuate groove having surfaces that form said blocking means, said stop means, and said abutment means; said groove receiving said one end of said control tumbler only with said control tumbler removed from said control shell tumblerway, and said groove accommodating said one end during rotational movement of said plug while preventing axial movement thereof.

10. A cylinder lock according to claim 9 wherein said locking tumblers project into said locking shell tumblerways when in said active positions, and said control tumbler projects into said control shell tumblerway when in said release position.

11. A cylinder lock according to claim 10 wherein with a proper key in said keyway said plug is rotatable from said locked position to said open position, and said control plug and control plug tumblerway are shaped and arranged so as to permit entry thereinto of said control tumbler only with said plug in said open position.

* * * * *